US007458531B2

(12) United States Patent
Mochizuki et al.

(10) Patent No.: US 7,458,531 B2
(45) Date of Patent: Dec. 2, 2008

(54) FUEL INJECTION VALVE

(75) Inventors: Kouichi Mochizuki, Anjo (JP); Kimitaka Saito, Nagoya (JP); Hiroaki Nagatomo, Tsushima (JP)

(73) Assignee: Denso Corporation (JP)

( * ) Notice: Subject to any disclaimer, the term of this patent is extended or adjusted under 35 U.S.C. 154(b) by 282 days.

(21) Appl. No.: 11/447,914

(22) Filed: Jun. 7, 2006

(65) Prior Publication Data

US 2006/0283988 A1 Dec. 21, 2006

(30) Foreign Application Priority Data

Jun. 10, 2005 (JP) ..... 2005-171509
Mar. 9, 2006 (JP) ..... 2006-064535

(51) Int. Cl.
*F02M 51/00* (2006.01)

(52) U.S. Cl. ..... 239/585.5; 239/585.1; 251/129.21; 251/335.3

(58) Field of Classification Search ..... 239/585.1, 239/585.4, 585.5; 251/129.15, 129.21, 335.1, 251/335.2, 335.3
See application file for complete search history.

(56) References Cited

U.S. PATENT DOCUMENTS 5,762,272 A 6/1998 Tani et al.
6,969,009 B2 * 11/2005 Bachmaier et al. ..... 239/585.1
7,044,407 B2 * 5/2006 Fischer et al. ..... 251/335.3
7,195,182 B2 * 3/2007 Fischer et al. ..... 239/585.5
7,309,032 B2 * 12/2007 Fischer et al. ..... 239/585.1

FOREIGN PATENT DOCUMENTS

JP 10-141168 5/1998
JP 2002-310030 10/2002

* cited by examiner

*Primary Examiner*—Steven J Ganey
(74) *Attorney, Agent, or Firm*—Nixon & Vanderhye PC

(57) ABSTRACT

A fuel injection valve includes a valve body having a valve seat, a valve element adapted to sit on and leave a valve seat, a nozzle hole for the injection of fuel, and an electromagnetic drive section. A holding member surrounds and holds, on one end side thereof, at least a partial area of an opposite-to-nozzle-hole-side end face portion of the valve element. The holding member surrounds and holds, on an opposite end side thereof, a predetermined surface area of a constant position holding portion without being influenced by the pressure of fuel flowing through a fuel passage of the valve body and irrespective of movement of the valve element. An internal area of the holding member is shut off so as not to be influenced by the pressure of fuel present around the internal area.

16 Claims, 7 Drawing Sheets

FUEL INJECTION VALVE

CROSS-REFERENCE TO RELATED APPLICATION

This application is based on Japanese patent Applications No. 2005-171509 filed on Jun. 10, 2005, and No. 2006-64535 filed on Mar. 9, 2006, the disclosure of which are incorporated herein by reference.

FIELD OF THE INVENTION

The present invention relates to a fuel injection valve, which supplies fuel by injection into an internal combustion engine.

BACKGROUND OF THE INVENTION

JP-9-14090A and JP-2002-310030A show a fuel injection valve having an electromagnetic solenoid which magnetically attracts a movable core connected to a valve needle and adapted to cooperate with the valve needle, thereby driving the valve needle directly. The valve needle is adapted to sit on and leave a valve seat. The fuel injection valve of this type is provided with an elastic member such as a spring for urging the valve needle toward the valve seat. The movable core is provided at an end of the valve needle on the side opposite to the valve seat, and a valve member comprising the valve needle and the core is exposed into fuel in the whole area of its end portion opposite to a nozzle hole. More particularly, for example as shown in FIG. 9, fuel of which pressure has been increased to a predetermined pressure is conducted to a fuel inlet formed in a fuel introducing portion 948 of a fuel injection valve 902 on the side opposite to a fuel injection valve 902, then passes through the interior of the fuel injection valve 902 and reaches a nozzle hole 921. In the fuel injection valve 902 thus allowing the fuel to pass therethrough, a whole surface 951*a* of an upper end portion 951 of a movable core 950 is exposed into the fuel. The upper end portion corresponds to the whole area of the end portion opposite to the nozzle hole. The movable core 950 is connected to a needle 930 and adapted to cooperate with the needle.

When the fuel injection valve closes, the needle is made to sit on the valve seat with the urging force of the elastic member to keep the valve closed. With the valve closed, not only the urging force of the elastic member but also the pressure of the fuel introduced into the fuel injection valve is applied in the valve closing direction.

The direct injection type engine tends to be produced from the standpoint of improving fuel economy and output. However, in case of injecting fuel directly into a combustion chamber from a fuel injection valve, the needle is urged with a large force in the valve closing direction because of a high fuel pressure for direct injection. Moreover, under an inter-cylinder combustion pressure, it is necessary to increase the urging force of the elastic member and urge the needle strongly toward the valve seat lest the needle should be opened with the combustion pressure even when the fuel pressure is low at the time of start-up for example.

Thus, the solenoid requires energy large enough to overcome the urging force induced by fuel and the urging force induced by the elastic member, as a driving force necessary for opening the valve.

SUMMARY OF THE INVENTION

The present invention has been accomplished taking the above circumstances into account and it is an object of the invention to diminish the driving force of an electromagnetic drive portion for opening a fuel injection valve.

It is another object of the present invention to provide a fuel injection valve which, even when influenced by an intra-cylinder pressure of an internal combustion engine, can diminish the driving force of an electromagnetic drive section for opening the valve and can keep a valve member closed.

According to the present invention there is provided a fuel injection valve comprising a valve body, the valve body having a valve seat on an inner periphery surface thereof which forms a fuel passage, a valve element adapted to sit on and leave a valve seat, a nozzle hole formed downstream of the valve seat to inject fuel which is fed from the fuel passage, and an electromagnetic drive section which generates a driving force for attracting the valve element magnetically. The fuel injection valve further comprises a holding member. The holding member surrounds and holds, on one end side thereof, at least a partial area of an opposite-to-nozzle-hole-side end face portion of the valve element located on the side opposite to the nozzle hole. The holding member surrounds and holds, on an opposite end side thereof, a predetermined surface area of a constant position holding portion which is held at a predetermined position without being influenced by the pressure of fuel flowing through the fuel passage and irrespective of movement of the valve element. The holding member provides an elastic connection between mutually opposed end faces of the opposite-to-nozzle-hole-side end face portion and the constant position holding portion. An internal area of the holding member surrounded between the partial area on the one end side and the predetermined surface area on the opposite end side is shut off so as not to be influenced by the pressure of fuel present around the internal area.

According to this construction, it is possible to lessen the influence of fuel pressure acting on the valve element in the valve closing direction and hence possible to diminish the driving force of the electromagnetic drive section for opening the valve.

DETAILED DESCRIPTION OF THE PREFERRED EMBODIMENTS

Fuel injection valves for the supply of fuel to a gasoline engine according to embodiments of the present invention will be described in detail hereinunder with reference to the accompanying drawings.

First Embodiment

Figure 1:
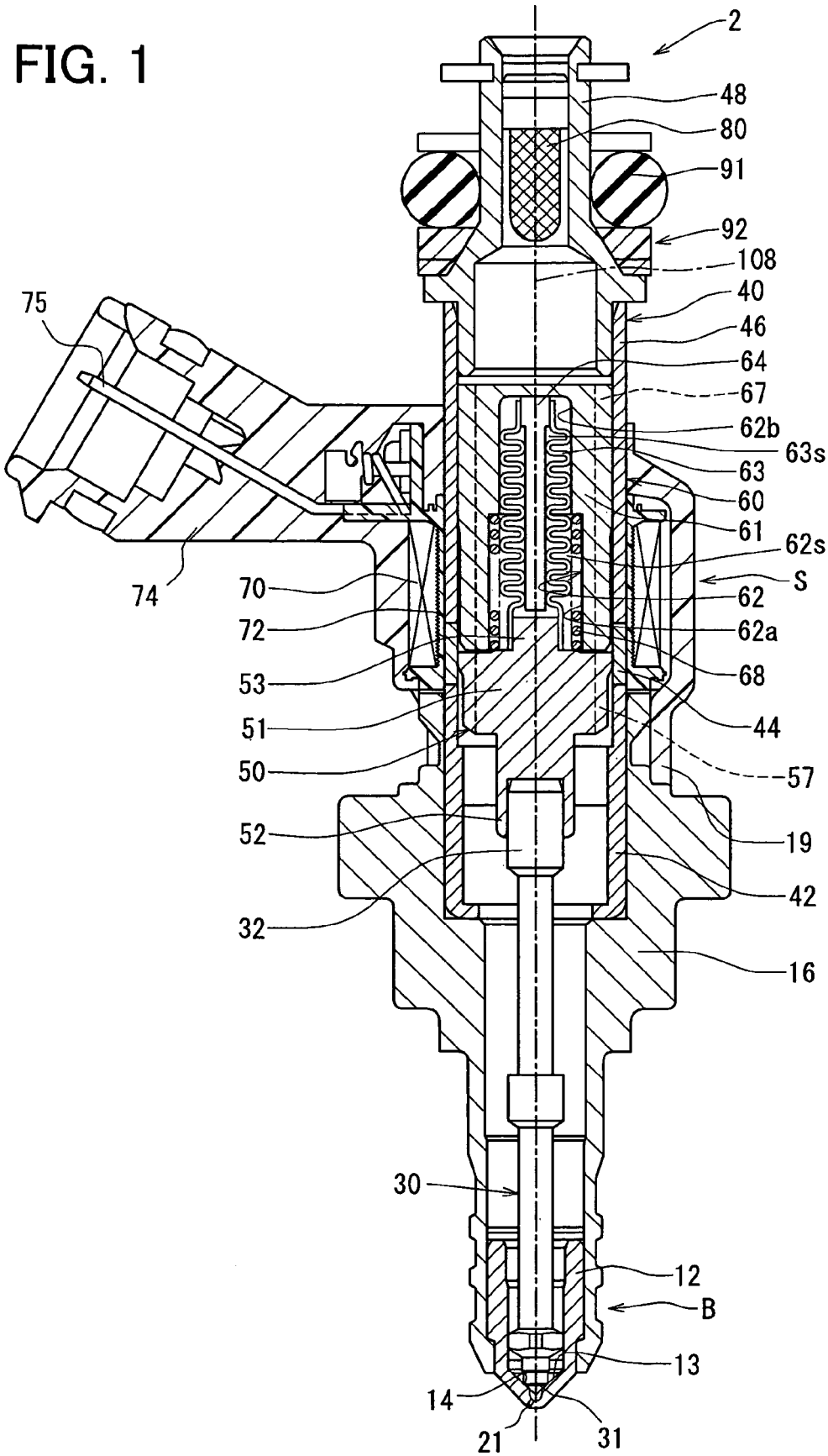
FIG. 1 is a sectional view showing the construction of a fuel injection valve according to a first embodiment of the present invention.

FIG. 1 is a sectional view showing the construction of a fuel injection valve according to a first embodiment of the present invention. FIG. 1 shows a state in which the fuel injection valve is closed and an electromagnetic drive section is not in operation.

As shown in FIG. 1, the fuel injection valve 2 is used in an internal combustion engine, especially a gasoline engine. The fuel injection valve 2 is mounted to for example an intake pipe or each cylinder in a multi-cylinder (e.g., four-cylinder) gasoline engine (hereinafter referred to simply as "engine") to inject fuel into a combustion chamber formed in each cylinder. In this embodiment it is assumed that the fuel injection valve 2 is provided in each cylinder. Fuel pressurized by a fuel pump (not shown) is fed to the fuel injection valve 2 through a fuel distribution pipe (not shown). Generally, fuel present within a fuel tank (not shown) is pumped up and discharged by a fuel pump (not shown) and is then conducted into the fuel distributing pipe. The discharged fuel is adjusted to a predetermined pressure by a pressure regulating device such as a pressure regulator (not shown) and is then fed to the fuel distributing pipe. In the case of a direct injection engine, the pressure of fuel fed to a combustion chamber in the internal combustion engine is adjusted to about 2 MPa or higher. To this end, fuel of a predetermined low pressure (e.g., 0.2 MPa) pumped up from the fuel tank by the fuel pump is pressurized by a high pressure pump (not shown) and the fuel thus pressurized to a predetermined high pressure (e.g., in the range of 2 to 13 MPa) is fed to the fuel injection valve 2 through the fuel distributing pipe 2. The pressure of the fuel discharged from the fuel pump and that of the fuel fed from the high-pressure pump to the fuel distributing pipe are each adjusted to a predetermined pressure by a pressure regulating device such as, for example, a pressure regulator (not shown). The engine related to this embodiment is assumed to be a direct injection type gasoline engine.

The fuel injection valve 2, which is generally cylindrical in shape as shown in FIG. 1, receives fuel from one end thereof and injects the fuel from an opposite end thereof through a fuel passage formed in the interior of the valve. The fuel injection valve 2 includes a valve section B for cutting off and permitting the injection of fuel, an electromagnetic drive section S for driving the valve section B, and a cylindrical receptacle 63. The fuel admitted into the fuel passage from one end of the fuel injection valve 2 is injected from the valve section into the associated cylinder in the engine.

Figure 3:
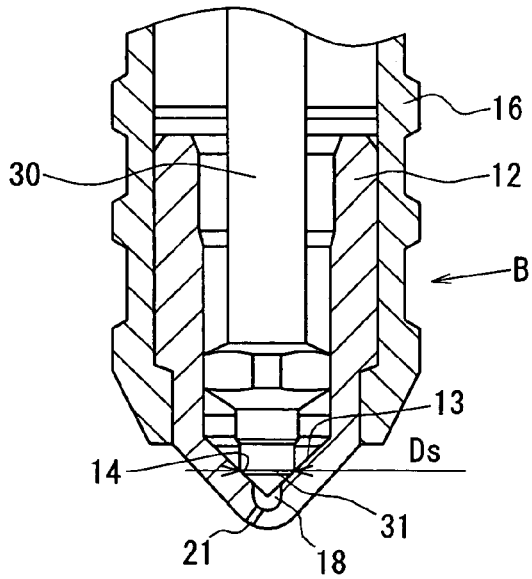
FIG. 3 is a partial sectional view showing a valve element and a valve body both shown in FIG. 1.

As shown in FIGS. 1 and 3, the valve section B includes a nozzle body 12 as a valve body and a needle 30 as a valve member. The fuel flowing through the interior fuel passage is conducted to the inner periphery of the nozzle body 12. The nozzle body 12 has a conical surface 13 as an inner periphery surface which becomes smaller in diameter toward a nozzle hole 21 in the fuel flowing direction. The needle 30 can sit on and leave the conical surface 13. The conical surface 13 constitutes a valve seat 14 which permits the needle 30 to sit thereon and leave. More specifically, an abutting portion 31 as a seat portion of the needle 30 sits on and leaves the valve seat 14. The valve seat 14 and the abutting portion 31 constitute a seat portion which fulfills an oil sealing function for the valve section to stop the injection of fuel.

Centrally of the valve seat 14 is formed the nozzle hole 21 which can communicate with the interior fuel passage toward the downstream side of the valve seat 14 in the fuel flowing direction. The size, axial direction and layout of the nozzle hole 21 are determined in accordance with required shape, direction and number of fuel spray.

An opening area of the nozzle hole defines the flow rate when the valve is open. Therefore, the amount of fuel to be injected by the fuel injection valve 2 is adjusted in accordance with the opening area of the nozzle hole 21, lift quantity HD1 of the needle 30 and a valve open period.

When the needle 30 sits on the valve seat 14, the injection of fuel from the nozzle hole 21 is stopped, while when the needle 30 leaves the valve seat 14, fuel is injected from the nozzle hole 21.

The nozzle body 12 is fixed for example by welding to the inner wall of a fuel injection-side end portion of a valve housing 16. The nozzle body 12 is formed in a generally stepped, bottomed cylinder shape and is inserted into the inner periphery side of a lower end portion of the valve housing 16. The outer periphery of the nozzle body 12 becomes smaller in diameter downward from the stepped portion. When the stepped portion of the nozzle body 12 comes into abutment against a stepped portion formed on the inner periphery side of the valve housing 16, the nozzle body 12 is prevented from coming off from the valve housing 16 under the fuel pressure.

The nozzle body 12 and the valve housing 16 constitute a valve body having the valve seat 14 for sitting thereon and separation therefrom of the needle 30. No limitation is made to forming the nozzle body 12 and the valve housing 16 as separate members and fixing the two integrally by welding for example. Both may be initially formed in one piece with each other. Generally, the valve seat 14 of the valve body is required to have a relatively high abrasion resistance because the needle 30 sits on and leaves the valve seat repeatedly at every injection of fuel.

In this embodiment, the portion having the valve seat 14, i.e., the nozzle body 12, in the valve body is formed using a specific material relatively high in abrasion resistance, while the valve housing 16 on the side connected to the electromagnetic drive section (more particularly a tubular member 40) S may be formed using a material, e.g., an inexpensive material, other than the specific material.

The needle 30 is formed in a generally shaft shape and can reciprocate axially through the interior of the valve body 12. As shown in FIGS. 1 and 3, a tip portion of the needle 30 is formed generally in the shape of a conical surface and is positioned in such a manner that the vertex of the generally conical shape faces a fuel sump (hereinafter referred to as the "sac portion") 18 of a very small volume. The sac portion 18 is a sac hole of a small volume formed like a sac on the tip side of the nozzle body 12. In this embodiment, the sac portion 18 is formed in such a manner that the nozzle hole 21 extends through the valve body 12 to both the interior and the exterior, as shown in FIG. 3.

The abutting portion 31 is formed on a circular ridge portion on an upper bottom side of the generally conical shape and is linear-sealed to the valve seat 14 on a circle of a seat diameter Ds.

The shape of the tip portion of the needle 30 is not limited to the generally conical shape, but may be any other shape insofar as the shape adopted permits the linear seal. For example, it may be a generally truncated cone shape or a generally semispherical shape. The sealing method for the abutting portion 31 and the valve seat 14 is not limited to the liner sealing, but both may be surface-sealed on conical surfaces.

A movable core 50 is fixed to an end portion 32 of the needle 30 on the side opposite to the valve seat 14. The needle 30 and the movable core 50 reciprocate axially in cooperation with each other.

The needle 30 and the movable core 50 constitute the valve element. How to fabricate the valve element is not limited to fixing the needle 30 and the movable core 50 integrally to each other by welding or the like. The needle 30 and the movable core 50 may be integrally formed in one piece with each other.

Figure 2:
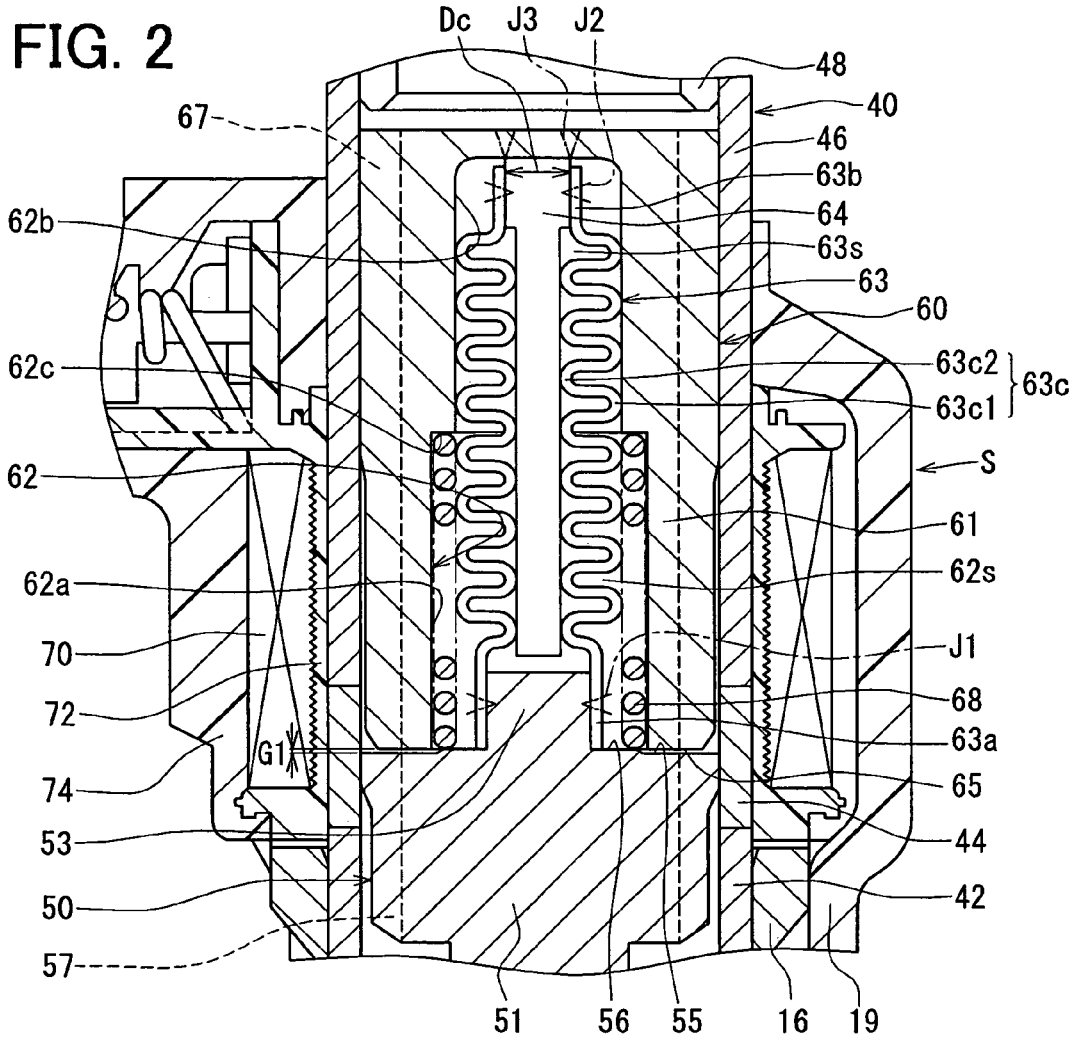
FIG. 2 is a partial sectional view showing an electromagnetic drive section and the vicinity thereof shown in FIG. 1.

As shown in FIGS. 1 and 2, the electromagnetic drive section S includes the tubular member 40, the movable core 50, a fixed core 60, and a coil 70.

The tubular member 40 is inserted inside the inner periphery wall of the valve body (more particularly, the valve housing 16) on the side opposite to the nozzle hole and is fixed to the valve body by welding for example. The tubular member 40 is made up of a first magnetic tubular portion 42, a nonmagnetic tubular portion 44, and a second magnetic tubular portion 46, in order from the nozzle hole 21 side. The nonmagnetic tubular portion 44 prevents a magnetic short-circuit between the first magnetic tubular portion 42 and the second magnetic tubular portion 46. By this prevention of the magnetic short-circuit, a magnetic flux induced by an electromagnetic force resulting from energization of the coil 60 is allowed to flow efficiently in both movable core 50 and fixed core 60.

The movable core 50 is formed using a magnetic material and is fixed for example by welding to the end portion 32 of the needle 30 on the side opposite to the valve seat 14. The movable core 50 reciprocates together with the needle 30. The movable core 50 includes a holding portion 52 fixed to the end portion of the needle 30, a body portion ("cylindrical portion" hereinafter) 51, and an end portion ("support end portion" hereinafter) fixed to an end portion 63*a* of a tubular receptacle 63. The holding portion 52 is formed at the nozzle hole-side lower end of the cylindrical portion 51, while the support end portion 53 is formed at the opposite-to-nozzle-hole-side upper end of the cylindrical portion 51. The support end portion 53 projects to the fixed core 60 side from upper end faces 55 and 56 as magnetic pole faces of the cylindrical portion 51. Of the upper end faces 55 and 56, the magnetic pole face 55 is disposed in opposition to a magnetic pole face 65 on the fixed core 60 side through a predetermined axial gap ("air gap" hereinafter) G1. The air gap G1 represents a separable distance, i.e., lift quantity HD1, of the needle 30 from the valve seat 14.

The support end portion 53 is located inside the magnetic pole face 55. In this case, as shown in FIG. 2, it is preferable that the magnetic pole face 55 be formed so as to provide a predetermined spatial difference in height with respect to the magnetic pole surface 56 located inside the magnetic pole face 55. According to this construction, at the upper end faces 55 and 56 the magnetic pole face 55 can be subjected to a finish work corresponding to the predetermined spatial difference in height, so that the air gap G1 can be controlled to the lift quantity HD1 throughout the whole periphery of including the magnetic pole face 65 on the fixed core 60 side and the magnetic pole face 55 opposed thereto.

Plural (two in this embodiment) fuel grooves 57 as fuel passages are formed in the outer periphery of the movable core 50 (more particularly, the cylindrical portion 51).

The fixed core 60 is formed in a generally cylindrical shape using a magnetic material. The fixed core 60 is inserted into the tubular member 40 and is fixed to the tubular member 40 by welding for example. The fixed core 60 is installed on the side opposite to the nozzle hole with respect to the movable core 50 and is in opposition to the movable core 50.

A bottomed receptacle hole 62 is formed inside the fixed core 60 on the magnetic pole 65 side. Plural (two in this embodiment) fuel grooves 67 as fuel passages are formed in the outer periphery of the fixed core 60. In this case, it is preferable that the fuel grooves 67 of the fixed core 60 and the fuel grooves 57 of the movable core 50 be formed so as to be axially opposed to each other. By so doing, when the fuel fed into the fuel injection valve 2 passes the fuel grooves 57 and 67, it is possible to suppress the flow of fuel flowing in between the magnetic pole faces 55 and 65 substantially in the peripheral direction of both magnetic pole faces.

Since the receptacle hole 62 does not extend through the fixed core 60 axially, when the fuel fed into the fuel injection valve 2 passes through the fixed core 60, the fuel flow is dammed up in the portion of the receptacle hole 62. Consequently, it is not likely at all that there may occur a fuel flow flowing in between the magnetic pole faces 55 and 65 substantially in the diametrical direction of both magnetic pole faces.

The tubular receptacle 63 is accommodated within the receptacle hole 62. A support member 64 is disposed on the bottom of the receptacle hole 62 and an end portion 63*b* of the tubular receptacle 63 is fixed to the support member 64. The diameter Dc of the support member 64 which fixes the end portion 63*b* as an open end has a predetermined section area.

The support member 64 is formed in a generally rod shape and extends toward the valve seat 14 through the interior of the tubular receptacle 63. Consequently, when the spacing between the end portions 63*a* and 63*b* becomes shorter axially with lift of the needle 30 in the valve opening operation of the needle 30, a contracting attitude of the tubular receptacle 63 can be guided by the support member 64 lest the tubular receptacle 63 should fall down with the contraction.

Inner peripheries 62*a* and 62*b* of the receptacle hole 62 are formed as stepped inner peripheries. The inner periphery 62*a* is formed larger than the inner periphery 62*b*. A spring 68 as an urging member is disposed on the inner periphery 62*b* and is sandwiched in between the movable core 50 (more particularly the seating face 56) and the fixing core 60 (more particularly a seating face 62*c*). The spring 68 urges the movable core 50 toward the valve seat 14 and is disposed outside the tubular receptacle 63.

The fixed core 60 and the support member 64 constitute the fixed core. The fixed core 60 and the support member 64 are not limited to being integrally formed by for example welding separate members, but may be initially formed in one piece with each other. In this embodiment, the support member 64 and the bottom of the receptacle hole 62 are joined and fixed together by a welded portion J3.

As shown in FIGS. 1 and 2, the tubular receptacle 63 has both open ends 63*a* and 63*b* which can expand and contract in the axial direction. The tubular receptacle 63 can hold the interior in an airtight manner. The open ends 63*a* and 63*b* are connected respectively to an end portion of the valve element (more particularly, the support end portion 53 of the movable core 50) and an end portion of the electromagnetic drive section (more particularly, the support member 64 of the fixed core 60). It is optional whether the tubular receptacle 63 having such a construction is to be formed using a nonmetallic material such as a rubber or resin material or using a metallic material.

Likewise, it is optional whether the tubular receptacle 63 which can expand and contract should exhibit an elastic force with expansion and contraction or should have flexibility with little elastic force. In the case of a tubular receptacle 63 having an elastic force, it is preferable that the tubular receptacle 63 be formed of a metallic material having resilience. As a result, the tubular receptacle 63 can exhibit a repulsive force according to the amount of expansion or contraction, i.e., an urging force acting to urge the movable core 50 toward the valve seat 14.

In the following description of this embodiment it is assumed that the tubular receptacle 63 is a bellows having large- and small-diameter portions alternately.

As shown in FIG. 2, the tubular receptacle 63 is a tubular portion wherein an intermediate portion ("contracting portion" hereinafter) 63*c* sandwiched in between both ends 63*a* and 63*b* has large-diameter portions 63*c*1 and small-diameter portions 63*c*2 in an alternate manner. Since the tubular receptacle 63 has the large- and small-diameter portions 63*c*1, 63*c*2 in an alternate manner, it can possess resilience which generates an urging force in accordance with the amount of expansion or contraction like the urging member 68 such as a compression spring which urges the valve element in the seating direction.

Both ends 63*a* and 63*b* are joined and fixed by for example welding to the support portion 53 of the movable core 50 and the support member 64 of the fixed core 60, respectively. The joining and fixing method is not limited to welding, but may be bonding with use of an adhesive or the like. When bonding the tubular receptacle 63 to both ends 63*a* and 63*b* in an airtight manner, it is preferable that the bonding be done in a hermetically sealed state under the atmospheric pressure as the internal pressure of the tubular receptacle 63. In this case, it is preferable that the air sealed into the interior of the tubular receptacle 63 be dry air, whereby it is possible to prevent moisture from being mixed into the interior of the tubular receptacle 63. Consequently, the internal pressure can be prevented from being increased by vapor pressure with a rise in temperature of the fuel injection valve 2. Moreover, the occurrence of rust caused by the incorporation of water can be prevented.

In the following description of this embodiment it is assumed that both ends 63*a* and 63*b* are joined together by welding. It is preferable that a joined portion J1 between the open end 63*a* and the support portion 53 and a joined portion J2 between the open end 63*b* and the support member 64 be welded by full-circled welding using a laser for example. By adopting such a joining structure it is possible to effect joining and fixing in an airtight manner, so that a space 63*s* which is partitioned into the interior of the tubular receptacle 63 and the movable core 50 (more particularly, the support portion 53), as well as the fixed core 60 (more particularly, the support member 64), can be formed in an airtight manner.

In this embodiment it is preferable that the tubular receptacle 63 be adjusted its axial length between both expansion/contraction ends 63*a* and 63*b* and be fixed at the joined portions J1 and J2. Since the tubular receptacle 63 is thus fixed while adjusting its length between both ends 63*a* and 63*b*, it is possible to adjust the urging force for urging the valve element in the valve closing direction. The valve elements 30 and 50 are urged toward the valve seat 14 with the urging force of the spring 68 and that of the tubular receptacle 63.

In this embodiment it is preferable that the tubular receptacle 63 be formed using a material having corrosion resistance. In this embodiment, the bellows 63 is formed using a metallic material, e.g., stainless steel. Certain fuel properties may exert an influence of sulfur component or acidity on the tubular receptacle. On the other hand, in this embodiment, since the tubular receptacle 63 is formed of stainless steel having corrosion resistance to sulfur component and to acidity, it is possible to improve the reliability of the tubular receptacle 63 and hence of the fuel injection valve 2.

A coil 70 is wound round a spool 72 or the like. A terminal 75 is insert-molded in a connector 74 for example and is connected electrically with the coil 70. When the coil 70 is energized, a magnetic attraction acts between the movable core 50 and the fixed core 60, so that the movable core 50 is attracted toward the fixed core 60 against the urging force of the compression spring 68 and that of the tubular receptacle 63.

As shown in FIG. 1, a filter 80 is disposed within a fuel introducing section 48 upstream of the fixed core 60 in the fuel flowing direction. Foreign matters such as a magnetic material contained in the fuel fed into the fuel injection valve 2 are removed by the filter 80. The fuel fed into the fuel injection valve 2 successively passes the filter 80 disposed within the fuel introducing section 48, the fuel passage formed within the tubular member 40, the fuel passages (more particularly, the fuel grooves 67) formed on the outer periphery side of the fixed core 60, the fuel passages (more particularly, the fuel grooves 57) formed on the outer periphery side of the movable core 50, and between the inner periphery wall of the valve housing 16 and the outer periphery wall of the needle 30. The fuel is further conducted to the fuel passage formed between the inner periphery surface 13 of the nozzle body 12 and the outer periphery surface of the needle 30 and advances toward the nozzle hole 21.

As shown in FIGS. 1 and 3, the end portion (more particularly, the support portion 53) of the valve elements 30 and 50 on the side opposite to the valve seal 14 is connected to the corresponding end portion of the electromagnetic drive section (more particularly, the support member 64 of the fixed core 60) so as to be able to expand and contract axially by the tubular receptacle 63. Further, the internal space 63*s* formed between the support portion 53 and the support member 64 is isolated from the fuel flowing through the interior of the fuel injection valve 2 by means of the tubular receptacle 63. With this arrangement, the influence of the fuel pressure acting in the closing direction of the valve elements 30 and 50 is diminished by an amount corresponding to the sectional area of the end portion of the electromagnetic drive section, i.e., a predetermined sectional area of the support member 64. Thus, the energy required for actuating the valve elements 30 and 50 in the valve opening direction can be diminished and hence it is possible to diminish the driving force of the electromagnetic drive section.

The operation of the fuel injection valve 2 constructed as above will now be described. When the vehicle engine key is turned to IG position, causing an ignition switch (not shown) to turn ON, whereby the fuel pump is actuated and the fuel present within the fuel tank is pumped up by the fuel pump. The pressure of the fuel thus pumped up is then adjusted to a predetermined low level by the pressure regulator and the fuel of the predetermined low pressure is fed to the high-pressure pump. The low-pressure fuel is pressurized by the high-pressure pump and the thus-pressurized fuel is fed to the fuel distributing pipe. The pressure of the fuel thus fed to the pressure-distributing pipe is adjusted to a predetermined level by the pressure regulator and is then fed to the fuel injection valve 2 from each distribution port.

For injection of fuel from the fuel injection valve 2, an electric current is fed to the coil 70 of the fuel injection valve 2, and when the needle 30 leaves the valve seat 14 and starts lift, the needle 30 is opened and the injection of fuel from the nozzle hole 21 is started. The fuel is injected from the nozzle hole 21 and is fed in an atomized state into the associated combustion chamber in the engine. On the other hand, for stopping the injection of fuel, the supply of the electric current to the coil 70 is stopped and the lift of the needle 30 decreases under the urging forces of the spring 68 and the tubular receptacle 63. The fuel injection ends when the needle 30 sits on the valve seat 14. The injection period of fuel (fuel spray) injected from the fuel injection valve 2, i.e., the amount of fuel injected, is adjusted by adjusting period of energization of the coil 70.

The following description is now provided about the function and effect of this embodiment.

(1) The end portion (more particularly, the support portion 53) of the valve elements 30 and 50 on the side opposite to the valve seat 14 is connected for axial expansion and contraction to the corresponding end portion of the electromagnetic drive section (more particularly, the support member 64 of the fixed core 60) through the tubular receptacle 63. Further, the internal space 63*s* formed between the support portion 53 and the support member 64 is isolated from the fuel flowing through the interior of the fuel injection valve 2 by means of the tubular receptacle 63. With this arrangement, the influence of the fuel pressure acting in the closing direction on the valve elements 30 and 50 is diminished by an amount corresponding to the sectional area of the end portion of the electromagnetic drive section, i.e., the predetermined area of the support member 64. Thus, it is possible to diminish the energy required for actuating the valve elements 30 and 50 in the opening direction and hence possible to diminish the driving force of the electromagnetic drive section.

(2) Particularly, it is preferable for the support member 64 to be constructed so that its predetermined sectional area becomes equal to the sectional area of the seat diameter Ds sitting on the valve seat 14 of the valve elements 30 and 50. In the case where the portion corresponding to the predetermined section area of the support member 64 is of the diameter Dc, adjustment is made so that the diameter Dc and the seat diameter Ds become equal to each other.

As a result, with the valve elements 30 and 50 closed, the influence of fuel pressure acting in the closing direction of the valve elements 30 and 50 is eliminated. Consequently, the driving force of the electromagnetic drive section can be diminished irrespective of the pressure of fuel fed into the fuel injection valve 2. For example, it is possible to not only diminish the driving force of the electromagnetic drive section but also take an appropriate measure against an increase of fuel pressure.

(3) Since the end portion (more particularly, the support member 64) of the electromagnetic drive section connected to the tubular receptacle 63 is formed inside the magnetic pole face 65 of the fixed core 60, the tubular receptacle 63 can be disposed without impairing the electromagnetic force for magnetic attraction acting between the magnetic pole face 65 of the fixed core 60 and the magnetic pole face 55 on the valve elements 30 and 50 side opposed thereto.

(4) In this embodiment, inside the magnetic pole face 65 is disposed the receptacle hole 62 which accommodates the tubular receptacle 63 and which dams up the fuel flow.

Generally, in the case where a valve element end and the corresponding end of the electromagnetic drive section are connected together so as to be able to expand and contract axially through the tubular receptacle 63 and the interior is isolated from the fuel flowing through the fuel injection valve 2, the valve element end is of a solid structure. In this case it may be effective to adopt a construction wherein the fuel fed into the fuel injection valve 2 flows between electromagnetic force-acting pole faces of the valve element and the electromagnetic drive section. However, in the event a foreign matter should get into the fuel, it is likely that the foreign matter may bite in between the magnetic pole faces.

On the other hand, in this embodiment there may be adopted a construction wherein the flow of fuel flowing through the interior of the fuel injection valve 2 is dammed up in the portion of the receptacle hole 62 (more particularly, the bottom of the receptacle hole 62). According to this construction, a fuel flow passing between the magnetic pole faces 55 and 65 of the valve elements 30, 50 (more particularly, the movable core 50) and the electromagnetic drive section (more particularly, the fixed core 60) through the receptacle hole 62. Thus, it is possible to improve the resistance to foreign matters of the fuel injection valve 2.

(5) In this embodiment, the tubular member 63 and the spring 68 for urging the valve elements 30 and 50 in the closing direction are doubly disposed inside and outside.

In case of disposing the spring 68 and the tubular receptacle 63 within the fuel injection valve 2, there usually is adopted a construction wherein the spring 68 and the tubular receptacle 63 are disposed in series with each other. It is likely that the repulsive force of the tubular receptacle 63 adapted to expand and contract may increase or decrease in accordance with the amount of expansion or contraction based on elastic characteristics of the material which forms the tubular receptacle 63. In such a case, it is difficult to adjust the urging member and the tubular receptacle each independently for adjusting the urging force applied to the valve elements 30 and 50 in the closing direction while the electromagnetic drive section is not in operation.

On the other hand, in this embodiment, since the tubular receptacle 63 and the spring 68 are doubly disposed inside and outside, the urging force of the spring 68 and the repulsive force of the tubular receptacle 63 can be adjusted each independently. Consequently, variations among products for example in closing responsivity of the fuel injection valve 2 can be diminished.

(6) In this embodiment, the end portion of the valve elements 30 and 50 (more particularly, the support portion 53) connected to the tubular receptacle 63 is formed inside the magnetic pole face 55 of the movable core 50. Consequently, the tubular receptacle 63 can be connected to the valve elements 30 and 50 without impairing the electromagnetic force for the magnetic attraction which acts between the magnetic pole face 55 of the valve elements 30, 50 and the magnetic pole face 65 on the fixed core 60 side opposed thereto.

(7) It is preferable for the tubular receptacle 63 to have an urging force for urging the valve elements 30 and 50 in the seating direction.

Generally, in the fuel injection valve 2, the member for urging the valve element in the seating direction is provided separately as such an urging member as a spring. On the other hand, in this embodiment, the tubular receptacle 63 can be used also as the urging member for urging the valve elements 30 and 50 in the seating direction.

(8) It is preferable for the tubular receptacle 63 to be formed by a bellows provided with the contracting portion 63*c* having large- and small-diameter portions 63*c*1, 63*c*2 in an alternate manner. According to this construction, the tubular receptacle 63 can be endowed with resilience for generating an urging force in accordance with the amount of expansion or contraction like such an urging member as the spring 68, e.g., a compression spring, which urges the valve elements 30 and 50 in the closing direction.

(9) In this embodiment it is preferable for the tubular receptacle 63 to be formed of a material having corrosion resistance. For example, the tubular receptacle 63 is formed by a stainless steel bellows. It is likely that certain fuel properties may exert an influence of sulfur component or acidity on the tubular receptacle. On the other hand, in this embodiment, since the tubular receptacle 63 is formed of a stainless steel material having corrosion resistance to sulfur component and acidity, it is possible to improve the reliability of the tubular receptacle 63 and hence of the fuel injection valve 2.

(10) In this embodiment, the end portion of the electromagnetic drive section connected to the tubular receptacle 63 is formed by the support member 64 which extends toward the valve seat 14 through the interior of the tubular receptacle 63. Consequently, in the opening operation of the needle 30 and when the spacing between the end portion 63*a* and 63*b* becomes shorter axially with lift of the needle 30, the contracting attitude of the tubular receptacle 63 can be guided by the support member 64 lest the tubular receptacle should fall down with contraction thereof.

(11) In this embodiment it is preferable that the axial length between both expansion/contraction ends 63*a* and 63*b* of the tubular receptacle 63 be adjusted and that the tubular receptacle 63 be fixed at the joined portions J1 and J2 such as welded portions. By thus fixing the tubular receptacle 63 while adjusting its axial length between both ends 63*a* and 63*b*, it is possible to adjust the urging force for urging the valve elements 30 and 50 in the closing direction. In this embodiment, the urging forces of the spring 68 and the tubular receptacle 63 urge the valve elements 30 and 50 in the closing direction.

(12) In the above urging force adjustment, since the urging force of the tubular receptacle 63 can be adjusted, it becomes easier to adjust the spring 68 and the tubular receptacle 63 each independently for adjusting the urging force for urging the valve elements 30 and 50 in the closing direction while the electromagnetic drive section is not in operation.

Second Embodiment

Another embodiment of the present invention will be described below. In the following embodiment, constituent portions same as or equal to those described in the first embodiment are identified by the same reference numerals as in the first embodiment, and explanations thereof will be omitted.

Figure 4:
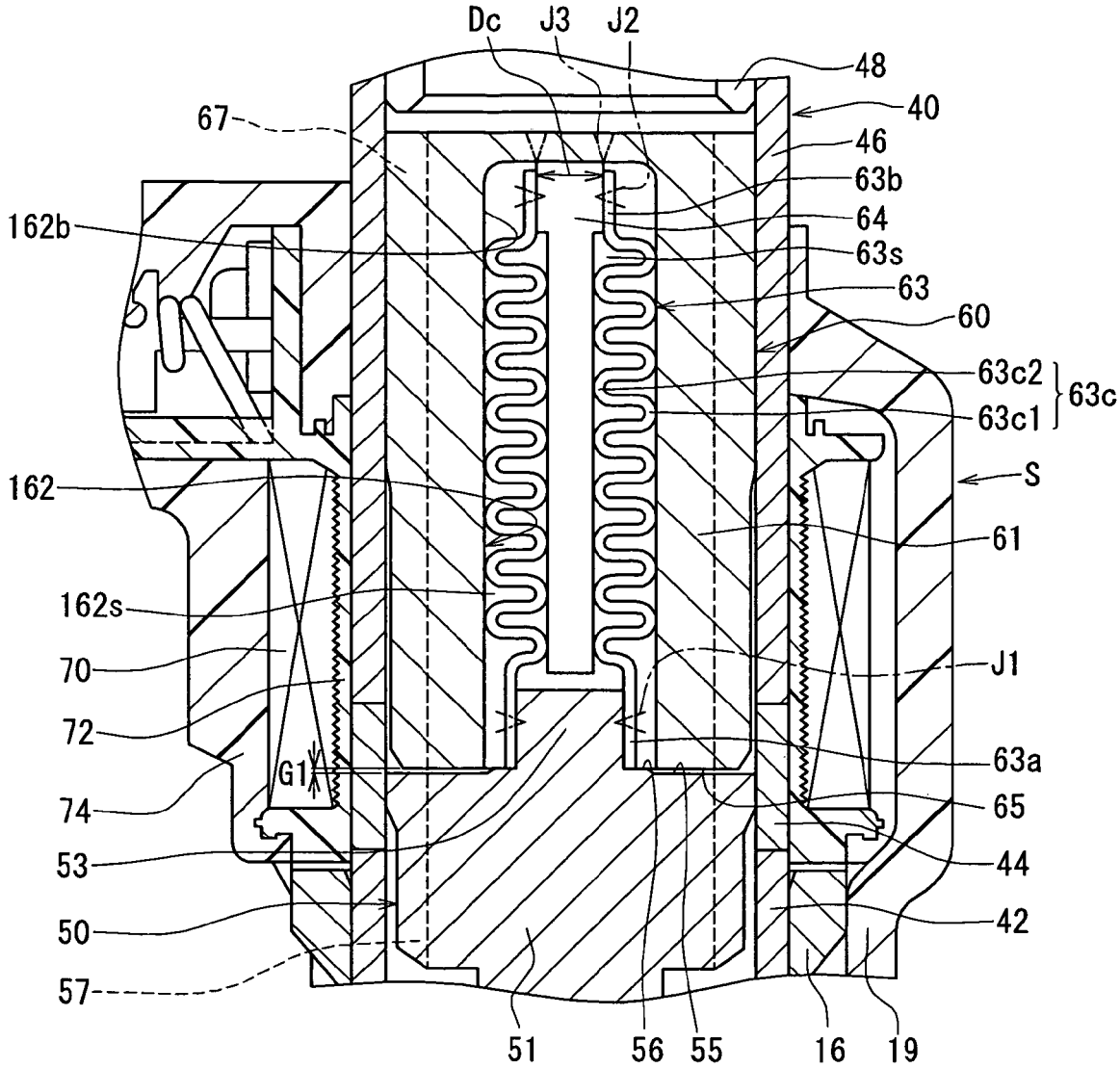
FIG. 4 is a partial sectional view showing an electromagnetic section and the vicinity thereof in a second embodiment of the present invention.

The first embodiment is constructed such that the urging force for urging the valve elements 30 and 50 in the closing direction can be obtained by the load on the spring 68 and that of the tubular receptacle 63. On the other hand, in this second embodiment, as shown in FIG. 4, the said urging force is obtained by the load on the tubular receptacle 63. FIG. 4 is a partial sectional view showing an electromagnetic drive section and the vicinity thereof related to this embodiment.

As shown in FIG. 4, a receptacle hole 162 is formed inside the magnetic pole face 65 of the fixed core 60. The receptacle hole 162 is formed with an inner periphery 162*b* for accommodating the tubular receptacle 63.

According to this construction, the spring 68 is not doubly disposed outside the tubular receptacle 63, nor is it necessary to dispose the spring 68 on the magnetic pole face, or seat face, 56 of the movable core 50.

Consequently, the opening of the receptacle hole 162 can be formed small and it is possible to enlarge the magnetic pole faces 65 and 55. As a result, the electromagnetic force induced in the coil 70 of the electromagnetic drive section 70 can be allowed to act effectively between the magnetic pole faces 65 and 55.

Next, the function and effect of this embodiment will be described.

(1) Since the tubular receptacle 63 is constructed by a tubular member having the aforesaid urging force, such as bellows, the tubular receptacle 63 can be used also as the member for urging the valve elements 30 and 50 in the seating direction. As a result, it is possible to reduce the number of constituent members of the fuel injection valve 2 and hence possible to simplify the structure of the same valve.

(2) With respect to the electromagnetic force induced in the coil 70, there sometimes is a case where it is difficult to ensure a magnetic flux flow path area necessary for generating a maximum attractive force within a limited outline size of the magnetic pole faces 55 and 56 due to for example restrictions in the mounting of the fuel injection valve 2.

On the other hand, in this embodiment, since the spring 68 is not doubly disposed outside the tubular receptacle 63, it is possible to make small the size of the opening of the receptacle hole 162. Consequently, it is possible to enlarge the magnetic pole faces 65 and 55 and hence possible to let the electromagnetic force induced in the coil 70 act effectively between the pole faces 65 and 55.

(3) In this embodiment, moreover, the above urging force adjustment can be done by only adjusting the urging force of the tubular receptacle 63. Therefore, it becomes easier to carry out the adjusting work to adjust the urging force for urging the valve elements 30 and 50 in the closing direction while the electromagnetic drive section is not in operation.

Third Embodiment

Figure 5:
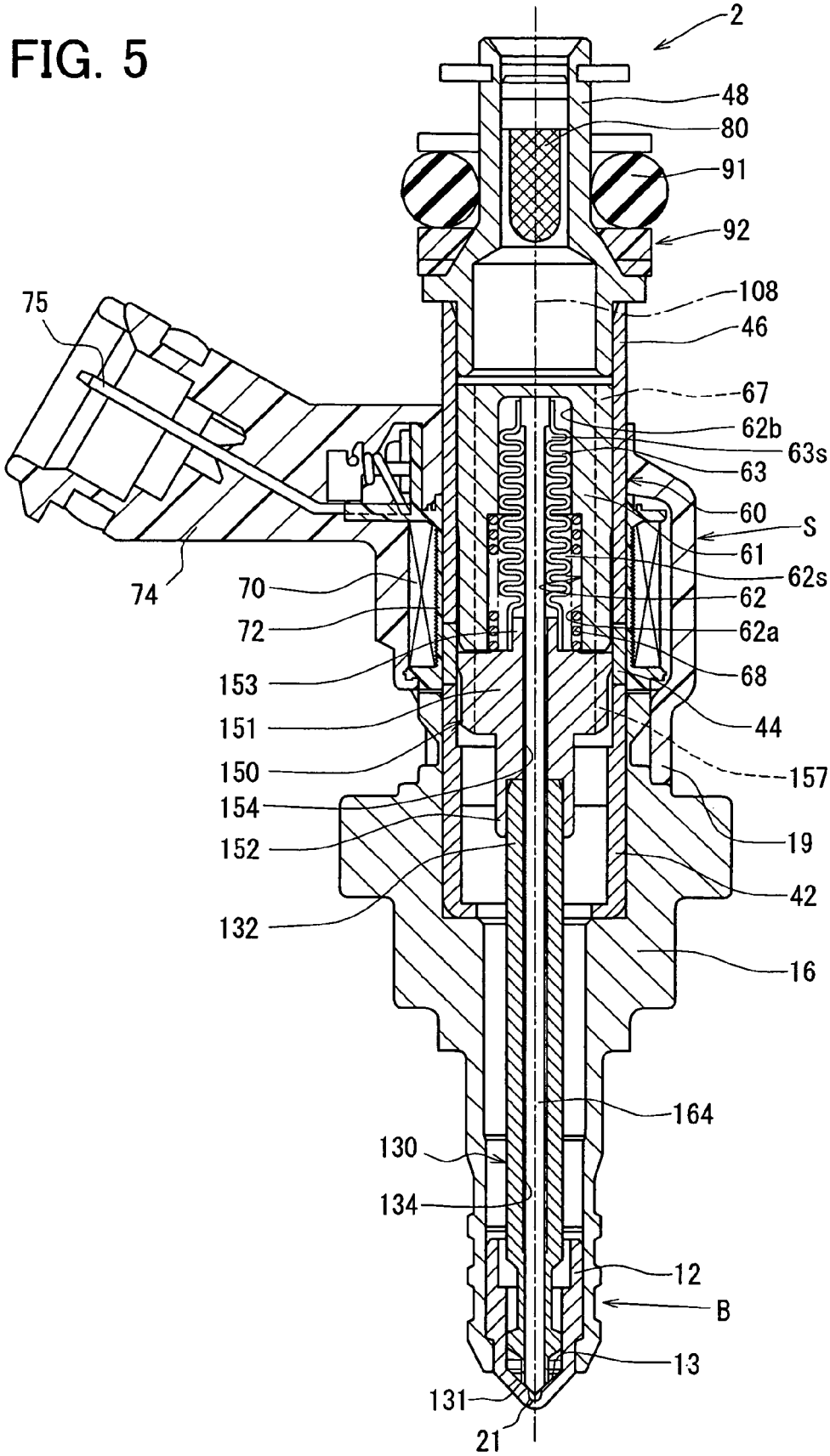
FIG. 5 is a sectional view showing the construction of a fuel injection valve according to a third embodiment of the present invention.
Figure 6:
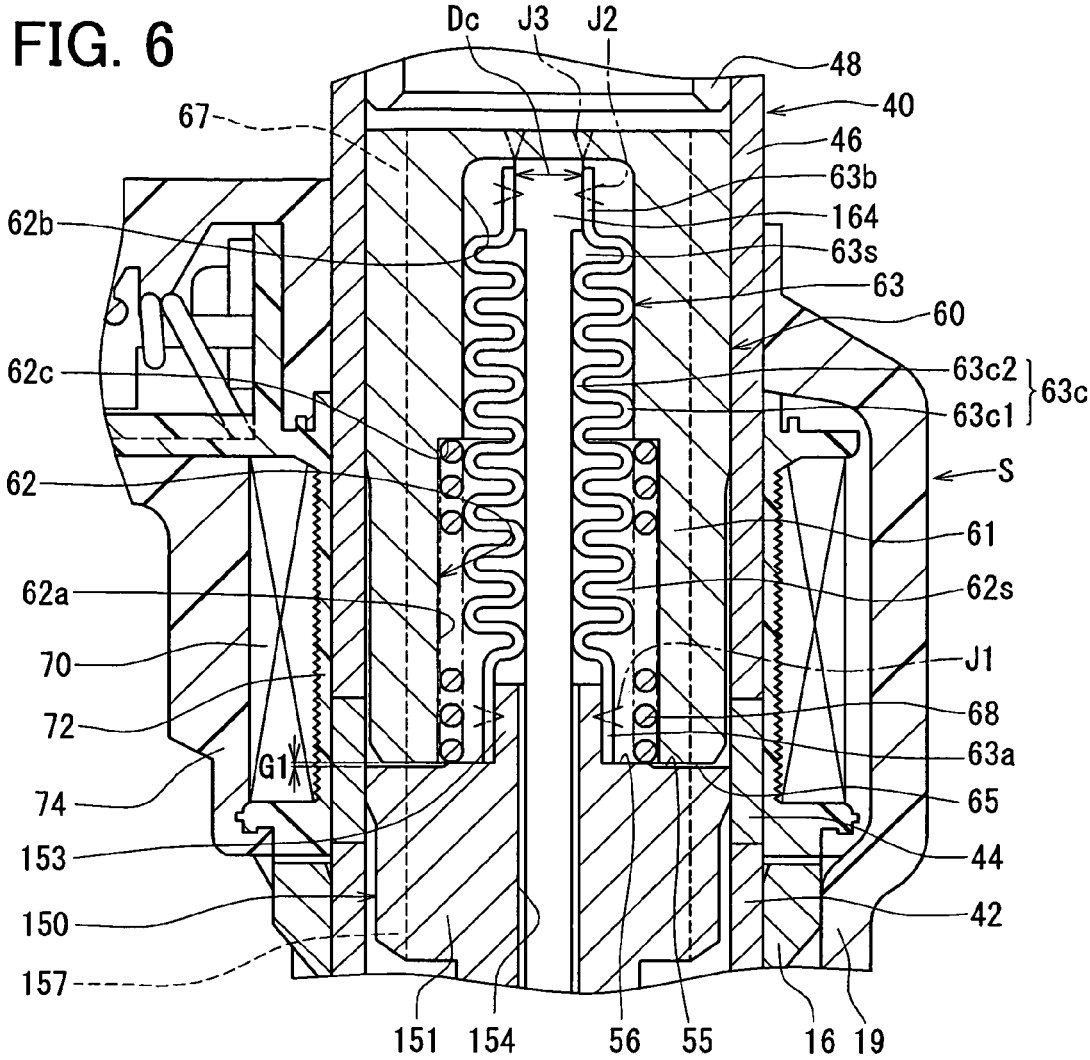
FIG. 6 is a partial sectional view thereof.
Figure 7:
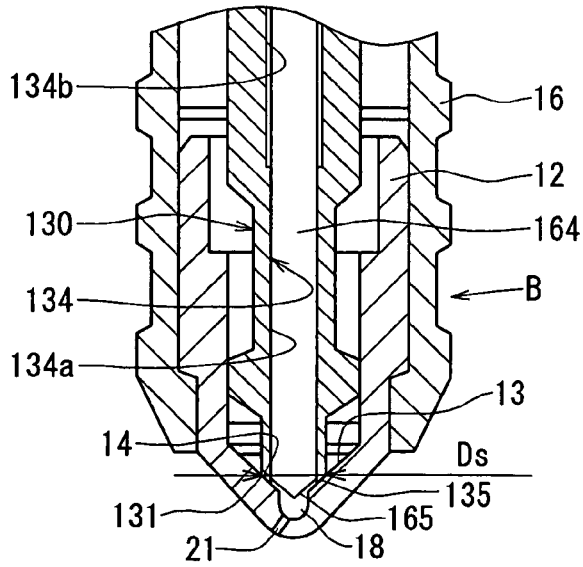
FIG. 7 is a partial sectional view showing a valve element and a valve body both shown in FIG. 5.

In a third embodiment of the present invention, as shown in FIG. 5, the valve element described in the first embodiment is modified so as to have inner peripheries 134 and 154 which permit insertion of a support member 164 toward the valve seat 14, and an opening of the inner periphery 134 located on the valve seat 14 side is positioned inside the valve seat 14. FIG. 5 is a sectional view showing the construction of a fuel injection valve according to this third embodiment. FIG. 6 is a partial sectional view of an electromagnetic drive section and the vicinity thereof shown in FIG. 5. FIG. 7 is a partial sectional view of the valve element and a valve body both shown in FIG. 5.

As shown in FIG. 5, the valve element is made up of a movable core 150 and a needle 130. The movable core 150 has a cylindrical portion 151, a holding portion 152, a support portion 153, and an inner periphery 154 extending axially through the interior of the movable core 150. The needle 130 has the inner periphery 134 which permits insertion of the support member 164 toward the valve seat 14.

According to this construction, a pressure receiving area of the valve element (more particularly, the needle 130) which receives an intra-cylinder pressure for example in the combustion stroke through the nozzle hole 21, the nozzle hole 21 facing the interior of a cylinder, e.g., a combustion chamber, is limited to the area, exclusive of the sectional area of the inner periphery 134, of a seat portion 131 (more particularly, the sectional area of the seat diameter Ds) which sits on the valve seat 14 of the needle 130. Consequently, in the case where the valve element receives the same intra-cylinder pressure at the time of closing of the fuel injection valve 2, the force based on the intra-cylinder pressure and acting to open the needle 130 can be diminished in comparison with the prior art. Therefore, it is not necessary to use a technique for strengthening the urging force for urging the needle 130 in the closing direction that contributes to an increase of the driving force of the electromagnetic drive section.

The inner peripheries 134 and 154 have an inner periphery portion which makes the support member 164 slidable in an airtight manner. In this embodiment, the said inner periphery portion is formed as part of the inner periphery of the needle 130. The said inner periphery portion is not limited to the inner periphery 134 of the needle 130, but may be formed as part of the inner periphery 154 on the movable core side.

As shown in FIG. 7, it is preferable that the aforesaid inner periphery portion be formed as part of the inner periphery 134 of the needle 130. As a result, it is possible to diminish the volume of the gap formed between the outer periphery of the support member 164 and the inner peripheries of the valve elements 130 and 150 and communicating with the fuel present within the sac portion 18. Therefore, it is possible to diminish a dead volume around the sac portion 18 when the valve is closed.

As shown in FIGS. 5 and 7, the aforesaid inner periphery portion is formed as part of the inner peripheries 134 and 154 of the needle 130 and the movable core 150. Consequently, in the valve portions 130 and 150, the entry of fuel into the tubular receptacle 63 is prevented by the inner periphery portion and it is possible to ensure isolation of the tubular receptacle 63 from the fuel positively, but also the productivity in the inner periphery machining can be improved by making limitation to the inner periphery portion of the inner peripheries 134 and 154.

As shown in FIG. 5, the support member 164 extends along an axis 108 toward the valve seat 14 and a tip portion 165 thereof is positioned so as to project from the opening of the inner periphery 134 on the valve seat 14 side. According to this construction the support member 164 is disposed so that its tip portion 165 projects from the opening on the valve seat 14 side formed in the needle 130. Therefore, it is possible to diminish a dead volume around the sac portion 18 formed between the tip portion 165 of the needle 130 and the nozzle hole 21 located downstream of the valve seat 14.

The tip portion 165 of the support member 164 is disposed in opposition to the inner periphery surface 13 of the nozzle body 12. It is preferable that the area of an opening formed by the gap between the opposed tip portion 165 and inner periphery surface 13 have a sectional area of a flow path able to ensure a flow rate equal to or larger than the amount of fuel injected from the nozzle hole 21. As a result, it is possible to improve the injection characteristic of the fuel injected from the fuel injection valve 2.

The function and effect of this third embodiment will now be described.

(1) According to the construction of this embodiment, the valve elements 130 and 150 have inner peripheries 134 and 154 which permit insertion of the support member 164 to the valve seat 14 side, and the opening of the inner periphery 134 on the valve seat 14 side is positioned inside the valve seat 14.

With this construction, the pressure receiving area of the valve element (more particularly, the needle 130) which receives an intra-cylinder pressure for example in the combustion stroke through the nozzle hole 21 facing the interior of a cylinder, e.g., a combustion chamber, is limited to the area, exclusive of the sectional area of the inner periphery 134, of the seat portion 31 (more particularly, the sectional area of the seat diameter Ds) sitting on the valve seat 14 of the needle 130. Consequently, in the case where the valve element receives the same intra-cylinder pressure in a closed state of the fuel injection valve 2, it is possible to decrease the force based on the intra-cylinder pressure acting to open the needle 130, in comparison with the prior art.

Therefore, it is not necessary to use a technique for enhancing the urging force for urging the needle 130 in the closing direction which contributes to an increase of the driving force of the electromagnetic drive section. For example, even when the valve element is influenced by the intra-cylinder pressure for example, it is possible to keep the valve element closed without increasing the driving force of the electromagnetic drive section for opening the valve.

(2) The inner peripheries 134 and 154 have an inner periphery portion which makes the support member 164 slidable in an airtight manner. In this embodiment it is preferable that the said inner periphery portion be formed as part of the inner peripheries 134 and 154 of the needle 130 and the movable core 150. As a result, in the valve elements 130 and 150, not only the entry of fuel into the tubular receptacle 63 from the inner periphery portion is prevented and the tubular receptacle 63 can be isolated positively from the fuel, but also the productivity in the inner periphery machining can be improved by making limitation to the inner periphery portion of the inner peripheries 134 and 154.

(3) It is preferable that the aforesaid inner periphery portion be formed as part of the inner periphery 134 of the needle 130. As a result, it is possible to diminish the volume of the gap formed between the outer periphery of the support member 164 and the inner peripheries of the valve elements 130 and 150. Therefore, it is possible to diminish the dead volume around the sac portion 18 when the valve is closed.

(4) The support member 164 extends in the axis 108 direction toward the valve seat 14 and is preferably disposed so that its tip portion projects from the opening of the inner periphery 134 on the valve seat 14 side. According to this construction the support member 164 is disposed so that its tip portion projects from the opening on the valve seat 14 side formed in the needle 130. Consequently, it is possible to diminish the dead volume around the sac portion 18 formed between the tip portion of the needle 130 and the nozzle hole 21 formed downstream of the valve seat 14.

(5) The tip portion of the support member 164 is positioned in opposition to the inner periphery surface 13 of the nozzle body 12, and it is preferable that the area of an opening formed by the gap between the opposed tip portion and the inner periphery surface 13 have a sectional area of a flow path able to ensure a flow rate equal to or larger than the amount of fuel injected from the nozzle hole 21. As a result, it is possible to improve the injection characteristic of the fuel injected from the fuel injection valve 2.

(6) The aforesaid inner periphery portion has been described as being able to make the support member 164 slidable in an airtight manner. Since it is not that the structure concerned is an airtightly slidable structure, it is not necessary to adopt a sealing structure having a sealing member such as an O-ring. Consequently, it is possible to reduce the number of components which constitute the fuel injection valve 2 and hence possible to attain the simplification of the fuel injection valve 2.

(7) There sometimes occurs a case where intake or exhaust gas flows from a cylinder into the valve through the nozzle hole 21 when the valve is closed, then passes through the gap between the inner periphery portion and the support member 164 and enters the internal space of the tubular receptacle 63. In this connection it is preferable that the tubular receptacle 63 be formed of a material having corrosion resistance. In this embodiment the tubular receptacle 63 is formed, for example, by a stainless steel bellows. Since the tubular receptacle 63 is thus formed of a stainless steel material having corrosion resistance to sulfur component contained in gas and to acidity, it is possible to improve the reliability of the tubular receptacle 63 and hence of the fuel injection valve 2.

Fourth Embodiment

Figure 8:
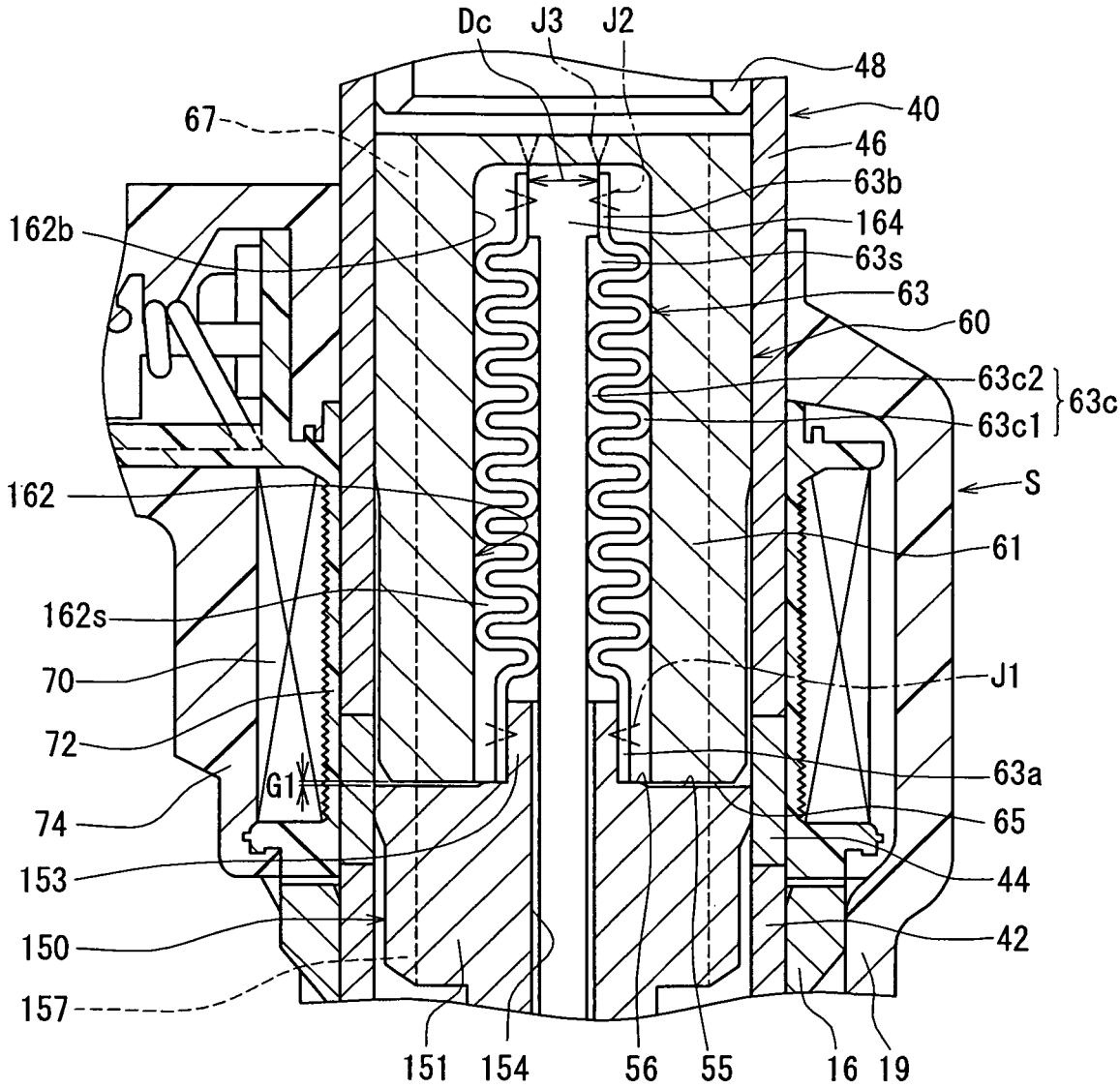
FIG. 8 is a partial sectional view showing an electromagnetic drive section and the vicinity thereof in a fourth embodiment of the present invention.
Figure 9:
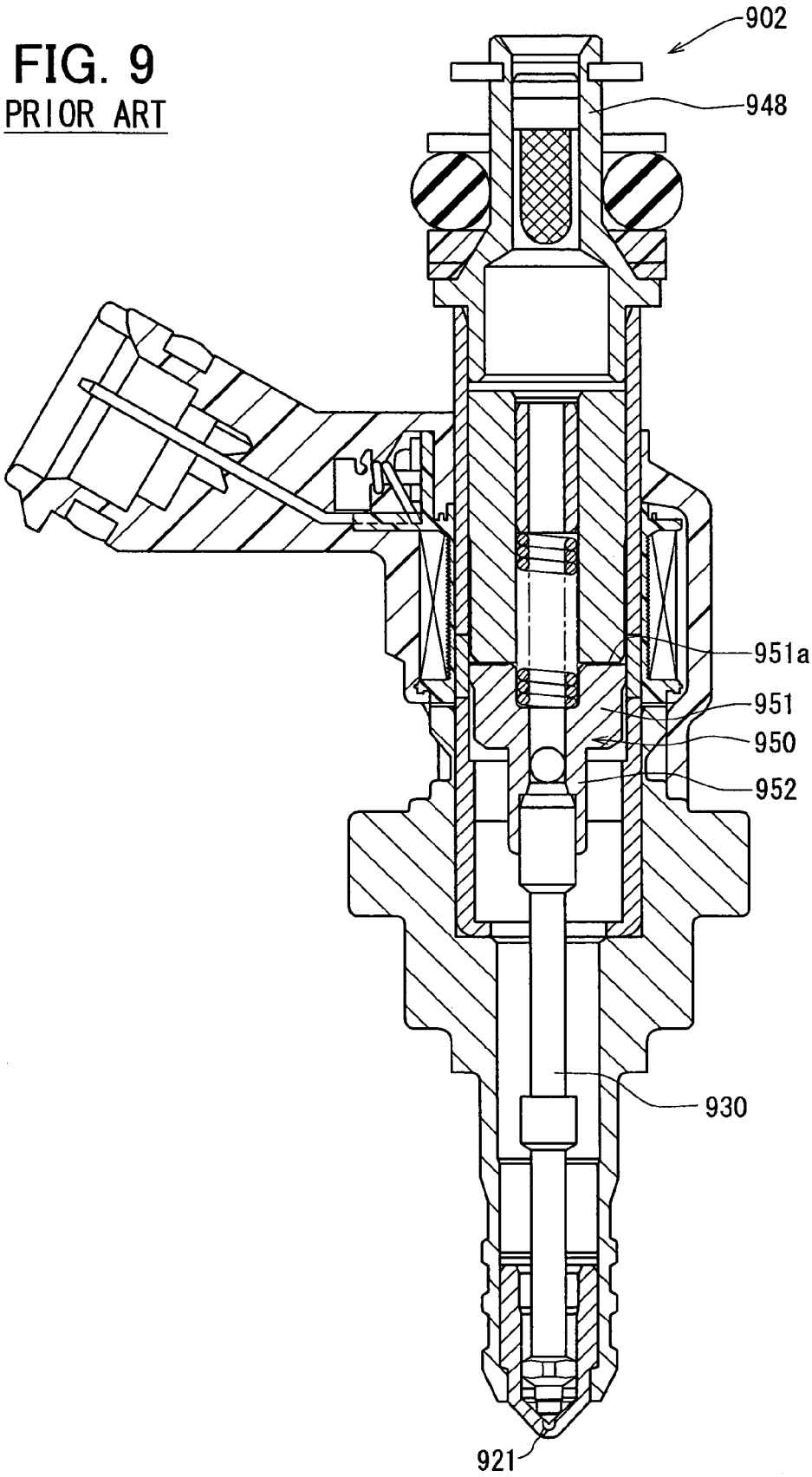
FIG. 9 PRIOR ART
FIG. 9 is a sectional view showing the construction of a conventional fuel injection valve.

In the construction of the previous third embodiment the urging force for urging the valve elements 130 and 150 in the closing direction is obtained by the load on both spring 68 and tubular receptacle 63. On the other hand, in this fourth embodiment, as shown in FIG. 8, the said urging force is obtained by the load on the tubular receptacle 63. FIG. 8 is a partial sectional view showing an electromagnetic section and the vicinity thereof according to this fourth embodiment.

As shown in FIG. 8, a receptacle hole 162 is formed inside the magnetic pole face 65 of the fixed core 60. The receptacle hole 162 has an inner periphery 162*b* for accommodating the tubular receptacle 63.

In this construction, the spring 68 is not doubly disposed outside the tubular receptacle 63, nor is it necessary to dispose the spring 68 on the magnetic pole face, i.e., seat face, 56 of the movable core 150.

According to this construction the opening of the receptacle hole 162 can be formed small and it is possible to enlarge the magnetic pole faces 65 and 55. Therefore, the electromagnetic force induced in the coil 70 of the electromagnetic drive section can be allowed to act effectively between the magnetic pole faces 65 and 55.

Next, the function and effect of this embodiment will be described.

(1) Since the tubular receptacle 63 is constructed by a tubular member having the aforesaid urging force, like a bellows, the tubular receptacle 63 can be used also as the member for urging the valve elements 30 and 50 in the seating direction. As a result, it is possible to reduce the number of the components which constitute the fuel injection valve 2 and hence possible to attain the simplification of the fuel injection valve 2.

(2) With respect to the electromagnetic force induced in the coil 70, there sometimes is a case where it is difficult to ensure a magnetic flux flow path area necessary for generating a maximum attractive force within a limited outline size of the magnetic pole faces 55 and 56 due to for example restrictions in the mounting of the fuel injection valve 2.

On the other hand, in this embodiment, since the spring 68 is not doubly disposed outside the tubular receptacle 63, it is possible to reduce the size of the opening of the receptacle hole 162. Consequently, it is possible to enlarge the magnetic pole faces 65 and 55 and hence possible to let the electromagnetic force induced in the coil 70 to act effectively between the magnetic pole faces 65 and 55.

(3) Since the pressure receiving area of the valve element (more particularly, the needle 130) which receives the aforesaid intra-cylinder pressure is limited to the area, exclusive of the sectional area of the inner periphery 134, of the seat portion 131 (more particularly, the sectional area of the seat diameter Ds) of the needle 130 sitting on the valve seat 14, it is possible to diminish the urging force for urging the valve elements 30 and 50 in the seating direction. Therefore, it is possible to diminish the urging force required of the tubular receptacle 63 which also serves as the urging member for urging the valve elements 30 and 50 in the seating direction. For example, in the case where the tubular receptacle 63 is designed as a bellows, it is possible to improve the design freedom, including resilience.

Other Embodiments (1) Although in the above embodiments the present invention has been described in terms of the fuel injection valve 2 for a direct injection engine, the engine to which the fuel injection valve of the present invention is applied is not limited to the direct injection type engine wherein fuel is injected directly into a combustion chamber within a cylinder. The fuel injection valve according to the present invention is also applicable to an engine of type in which fuel is injected into an intake pipe or the like and is thereby injected indirectly into a combustion chamber. It is suitable for the valve to be applied to an engine wherein the closed state of the needle is to be maintained against an external pressure such as an intra-cylinder pressure imposed on the nozzle hole.

(2) Although in the above embodiments the tubular receptacle 63 is a bellows of a concave-convex shape in section having large- and small-diameter portions 63*c*1, 63*c*2 in an alternate manner, it is not limited to a tubular body of a concave-convex shape in section, but may be a tubular body of a generally tapered or straight shape in section insofar as the tubular body adopted connects an end of the electromagnetic drive section and an end of the valve element so as to be able to expand and contract and can be isolated from the fuel flowing through its internal space into the fuel injection valve.

(3) Although in the valve bodies 30 and 50 described in the above embodiments the end portion connected to the open end 63*a* of the tubular receptacle 63 is the end portion 53 of the movable core 50 located on the side opposite to the valve seat 14, there may be adopted a construction wherein the end portion in question is the end portion of the needle 30 located on the side opposite to the valve seat 14. In this case, the end portion in question should be fixed to the needle so that the movable core permits insertion of the needle therein.

(4) In the electromagnetic section described in the above embodiments, the end portion connected to the open end 63*b* of the tubular receptacle 63 is the support member 64 of the fixed core 60, it may be the bottom of the receptacle hole 62 of the fixed core.

(5) Although in the above embodiments the holding member having the inner area 63*s* surrounded between the partial area 53 on one end side and the predetermined surface area dc on the opposite end side corresponds to the tubular receptacle 63, no limitation is made thereto. The holding member may be a generally rod-like member capable of expansion and contraction and having an inner area of a solid structure. In this case, the holding member formed by a generally rod-like member able to expand and contract is joined and fixed while being sandwiched in between the valve element and the fixed core.

(6) Although in the above embodiments the present invention is applied to the fuel injection valve wherein the fuel pressure acts in the valve closing direction on the valve elements 30 and 50 which sit on the valve seat 14, no limitation is made to such a fuel injection valve. The present invention is also applicable to a fuel injection valve wherein the fuel pressure acts in the valve opening direction on the valve element.

(7) In the above embodiments it has been described that the influence of the fuel pressure acting in the valve closing direction on the valve element is diminished by an amount corresponding to the sectional area of the end portion (more particularly, the support member 64) of the electromagnetic drive section to which the tubular receptacle 63 is connected. Consequently, when the sectional area of the end portion of the electromagnetic drive section is smaller than the sectional area of the seat diameter Ds, the fuel pressure acting in the valve closing direction on the valve element becomes less influential. Further, when the sectional area in question is equal to the sectional area of the seat diameter Ds, the influence of the fuel pressure acting in the valve closing direction of the valve element is removed.

The fuel injection valve can be constructed so that the fuel pressure acts in the valve opening direction on the valve element when the sectional area in question is smaller than the sectional area of the seat diameter Ds.

Although in the above embodiments the nozzle hole 21 is formed in the valve body (more particularly, the nozzle body 12) downstream of the valve seat 14, no limitation is made thereto. A nozzle plate having a nozzle hole may be provided at the tip of the nozzle body.

What is claimed is:

1. A fuel injection valve comprising:

a valve body forming a fuel passage therein;

a valve seat provided in the fuel passage;

a valve element adapted to sit on and leave the valve seat;

a nozzle hole formed downstream of the valve seat to inject fuel which is fed from the fuel passage;

an electromagnetic drive section which generates a driving force for attracting the valve element magnetically; and a holding member surrounding and holding, on one end side thereof, at least a partial area of an opposite-to-nozzle-hole-side end face portion of the valve element located on the side opposite to the nozzle hole, the holding member surrounding and holding, on an opposite end side thereof, a predetermined surface area of a constant position holding portion which is held at a predetermined position without being influenced by the pressure of fuel flowing through the fuel passage and irrespective of movement of the valve element, the holding member providing an elastic connection between mutually opposed end faces of the opposite-to-nozzle-hole-side end face portion and the constant position holding portion, an internal area of the holding member surrounded between the partial area on the one end side and the predetermined surface area on the opposite end side being shut off so as not to be influenced by the pressure of fuel present around the internal area, wherein the holding member is a tubular receptacle which connects an end portion of the valve element opposite to the valve seat and an end portion of the electromagnetic drive section opposite to said end portion with each other so as to permit axial expansion and contraction.

2. A fuel injection valve according to claim 1, wherein the sectional area of the predetermined surface area surrounded by the holding member on the opposite end portion side is set smaller than or equal to the sectional area of a seat portion of the valve element for sitting on the valve seat.

3. A fuel injection valve according to claim 2, wherein the sectional area of the end portion of the electromagnetic drive section is formed equal to or smaller than that of the seat portion of the valve element for sitting on the valve seat.

4. A fuel injection valve according to claim 1, wherein the electromagnetic drive section includes a fixed core having a magnetic pole face for attracting the valve element electromagnetically, and the end portion of the electromagnetic drive section is formed inside the magnetic pole face of the fixed core.

5. A fuel injection valve according to claim 4, wherein a receptacle hole for accommodating the tubular receptacle and damming up a fuel flow is formed inside the magnetic pole face.

6. A fuel injection valve according to claim 1, wherein the electromagnetic drive section includes an urging member for urging the valve element in the seating direction, and the urging member and the tubular receptacle are doubly disposed inside and outside.

7. A fuel injection valve according to claim 1, wherein the valve element includes a movable core having a magnetic pole face on which an electromagnetic force created by the electromagnetic drive section acts, and the end portion of the valve element is formed inside the magnetic pole face.

8. A fuel injection valve according to claim 1, wherein the tubular receptacle has an urging force for urging the valve element in the seating direction.

9. A fuel injection valve according to claim 8, wherein the tubular receptacle is a bellows having large-diameter portions and small-diameter portions in an alternate manner.

10. A fuel injection valve according to claim 1, wherein the tubular receptacle is formed of a material having corrosion resistance.

11. A fuel injection valve according to claim 1, wherein the end portion of the electromagnetic drive section is formed by a support member extending toward the valve seat through the interior of the tubular receptacle.

12. A fuel injection valve according to claim 11, wherein the valve element has an inner periphery which permits insertion therein of the support member toward the valve seat, the inner periphery being located inside the valve seat.

13. A fuel injection valve according to claim 12, wherein the inner periphery of the valve element has an inner periphery portion which makes the support member slidable in an airtight manner.

14. A fuel injection valve according to claim 12, wherein the support member is disposed so that a tip portion thereof projects from an opening of the inner periphery which opening is positioned on the valve seat side.

15. A fuel injection valve according to claim 12, wherein the tip portion of the support member is positioned in opposition to the inner periphery surface which forms the valve seat, and a gap formed between the tip portion and the inner periphery surface opposed to each other has an opening sectional area making it possible to ensure a flow rate equal to or larger than the, amount of fuel injected from the nozzle hole.

16. A fuel injection valve according to claim 1, further comprising a joining structure for joining and fixing both ends of the tubular receptacle to the end portion of the valve element and the end portion of the electromagnetic drive section, and wherein the tubular receptacle is joined and fixed in an adjusted state of its length between the both ends adapted to expand and contract.

* * * * *